US011672321B2

(12) United States Patent
Dempsey

(10) Patent No.: US 11,672,321 B2
(45) Date of Patent: Jun. 13, 2023

(54) MASCARA APPLICATOR

(71) Applicant: JILFINITY AND BEYOND, LLC., Beverly Hills, CA (US)

(72) Inventor: Jillian Dempsey, Beverly Hills, CA (US)

(73) Assignee: JILFINITY AND BEYOND, LLC., Beverly Hills, CA (US)

( * ) Notice: Subject to any disclaimer, the term of this patent is extended or adjusted under 35 U.S.C. 154(b) by 598 days.

(21) Appl. No.: 16/116,586

(22) Filed: Aug. 29, 2018

(65) Prior Publication Data

US 2020/0069032 A1 Mar. 5, 2020

(51) Int. Cl.

| | |
|---|---|
| ***A46B 9/02*** | (2006.01) |
| ***A45D 40/26*** | (2006.01) |
| ***A45D 40/18*** | (2006.01) |

(52) U.S. Cl.

CPC ..... *A45D 40/264* (2013.01); *A45D 40/18* (2013.01); *A45D 40/265* (2013.01); *A46B 9/021* (2013.01); *A46B 2200/1053* (2013.01)

(58) Field of Classification Search

CPC ..... A46B 5/00; A46B 5/021; A46B 5/0033; A46B 5/0054; A46B 5/0083; A46B 5/0087; A46B 5/0091; A46B 2200/00; A46B 2200/106; A46B 2200/1046; A46B 2200/1053; A46B 9/00; A46B 9/021; A46B 7/00; A46B 7/02; A46B 7/06; A46B 7/08; A46B 7/10; A46B 15/00; A46B 15/0055;

(Continued)

(56) References Cited

U.S. PATENT DOCUMENTS 4,165,755 A * 8/1979 Cassai ..... A45D 40/265 132/218
4,428,388 A * 1/1984 Cassai ..... A46B 9/021 132/218
6,497,235 B2 12/2002 Dorsa et al.

(Continued)

FOREIGN PATENT DOCUMENTS

FR 3023458 A1 1/2016
JP 2011115589 A 6/2011

(Continued)

OTHER PUBLICATIONS

International Search Report and Written Opinion in corresponding International Application No. PCT/US2019/048119 dated Nov. 13, 2019 (10 pages).

(Continued)

*Primary Examiner* — Cris L. Rodriguez
*Assistant Examiner* — Karim Asqiriba
(74) *Attorney, Agent, or Firm* — Jeffri A. Kaminski; Venable LLP

(57) ABSTRACT

A makeup applicator having a brush and a stamp at a distal end of the brush. The makeup applicator may apply mascara to eyelashes with the brush. The makeup applicator may apply a beauty mark to skin with the stamp. The stamp may pivot with respect to the brush. The stamp may be used as a stamp for a winged eye look. Accordingly, the stamp may be bend to the left and the right to allow for the winged eye look to be created on the left and right eyes. The stamp may be selectively pivotable about a longitudinal access of the mascara applicator. A method of creating a winged eye look with the makeup applicator.

16 Claims, 5 Drawing Sheets

(58) Field of Classification Search
CPC ..... A45D 40/00; A45D 40/18; A45D 40/264; A45D 40/265
USPC ..... 401/126–130; 15/105, 106, 172, 15/201–203
See application file for complete search history.

(56) References Cited

U.S. PATENT DOCUMENTS

| | | | | |
|---|---|---|---|---|
| 7,429,141 | B2 | 9/2008 | Habatjou | |
| 8,556,528 | B2 | 10/2013 | Gardner et al. | |
| 8,568,048 | B2 | 10/2013 | Chan | |
| 8,764,329 | B2 | 7/2014 | Hasty | |
| 8,783,989 | B2 | 7/2014 | Weigel et al. | |
| 9,210,988 | B2 | 12/2015 | Kim | |
| 9,301,592 | B2 | 4/2016 | Hofmann | |
| 9,339,098 | B2 | 5/2016 | Takata et al. | |
| 9,635,924 | B1 | 5/2017 | Herrera | |
| 10,610,005 | B2 * | 4/2020 | Kim | A46B 5/0058 |
| 2007/0025803 | A1 | 2/2007 | Dieudonat | |
| 2009/0194127 | A1 | 8/2009 | Pires et al. | |
| 2011/0135376 | A1 * | 6/2011 | Weigel | A46B 5/0087 401/29 |
| 2011/0297174 | A1 | 12/2011 | Ornoski et al. | |
| 2012/0305022 | A1 | 12/2012 | Bickford | |
| 2014/0033537 | A1 | 2/2014 | Ramakrishnan | |
| 2015/0117929 | A1 * | 4/2015 | Schreiber | A45D 40/262 401/25 |
| 2016/0081456 | A1 | 3/2016 | Grund et al. | |
| 2016/0128457 | A1 * | 5/2016 | Lim | A46B 9/021 401/118 |
| 2017/0231363 | A1 | 8/2017 | Herrera | |
| 2017/0258214 | A1 * | 9/2017 | Borsari | A46B 9/026 |
| 2017/0303659 | A1 | 10/2017 | Weigel | |
| 2017/0325576 | A1 | 11/2017 | Griffith | |
| 2018/0311062 | A1 * | 11/2018 | Pathak | A61F 4/00 |

FOREIGN PATENT DOCUMENTS

| | | | |
|---|---|---|---|
| JP | 2014524341 | A | 9/2014 |
| JP | 2016220731 | A | 12/2016 |
| KR | 20110009608 | U | 10/2011 |
| RU | 2410004 | C2 | 1/2011 |
| WO | 2013028766 | A1 | 2/2013 |
| WO | 2014065783 | A1 | 5/2014 |
| WO | 2017115825 | A1 | 7/2017 |

OTHER PUBLICATIONS

Givenchy; Givenchy Noir Interdit Lash Extension Effect Mascara; Reference Notes: Retrieved from: https://www.amazon.com/Givenchy-Noir-Interdit-Mascara-Black/dp/B01MZFM1EX (5 pages).

Shiseido; Full Lash Multi-Dimension Mascara; Reference Notes: Retrieved from: https://www.amazon.com/Shiseido-Full-Lash-Multi-Dimension-Mascara/dp/B072QZ66GD (5 pages).

Russian Office Action in corresponding Russian Application No. 2021107889 dated Sep. 16, 2021 (19 pages).

Canadian Office Action and Examination Search Report in corresponding Canadian Application No. 3,110,852 dated May 30, 2022 (4 pages).

Extended European Search Report in corresponding European Application No. 19854870.3 dated Apr. 26, 2022 (10 pages).

Japanese Office Action in corresponding Japanese Application No. 2021-537030 dated May 10, 2022 (12 pages).

Korean Office Action in corresponding Korean Patent Application No. 10-2021-7008894 dated Jan. 27, 2023 (16 pages).

Canadian Office Action and Examination Search Report in corresponding Canadian Application No. 3,110,852 dated Feb. 8, 2023 (5 pages).

* cited by examiner

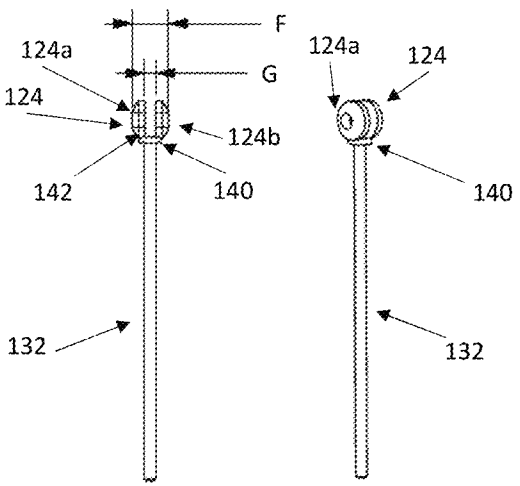
FIG. 4E
FIG. 4D
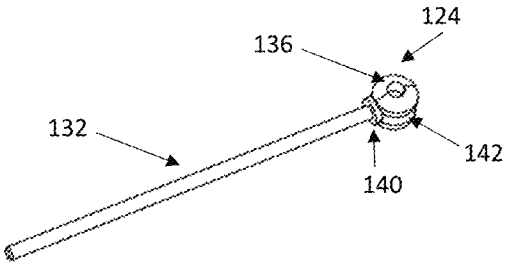
FIG. 4A
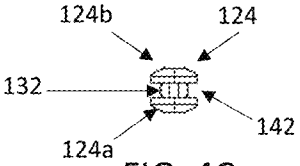
FIG. 4C
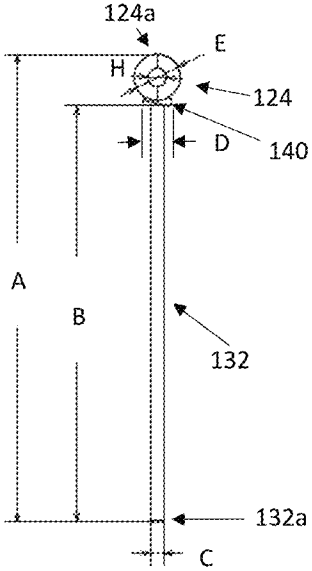
FIG. 4B

MASCARA APPLICATOR

TECHNICAL FIELD

The present disclosure relates to an applicator for applying mascara. More particularly, the present disclosure relates to a mascara applicator including an eyeliner stamp.

BACKGROUND

Currently, mascara and eyeliner are applied to a user's eyes in separate applications. Mascara may be applied to the eyelashes with a conventional mascara applicator or wand having bristles on an end thereof. Eyeliner, such as liquid, powder, wax, or gel eyeliner, may be applied to the upper eyelid or lower eyelid of a user with a conventional eye liner applicator. Eyeliner may be used to define the eye or create the appearance of a larger or smaller eye. In some cases, eyeliner is applied in a winged or cat technique to the upper eyelid. The winged eye look is currently achieved by drawing a wing or cat eye on an upper eyelid with conventional eye liner. Alternatively, eyeliner may be applied to a separate wing eyed shaped stamp, the stamp may then be applied to the eyelid. The aforementioned techniques are time consuming, require several products, and may be difficult as they require a high level of skill to execute. Additionally, these techniques are expensive as they require the user to purchase three separate applicators: mascara, eyeliner, and a stamp. Thus, a need exists for a simple to use and compact applicator for applying mascara and a stamped eye look, such as the winged eye.

BRIEF SUMMARY

According to an embodiment, a makeup applicator may include a wand; a brush coupled to the wand; and a stamp coupled to a distal end of the brush, the stamp configured to apply a beauty mark to a surface, wherein the stamp is configured to pivot with respect to the brush.

According to an embodiment, an insert for a makeup applicator may include a tip holder having a slot; a tip configured to be received in the slot and configured to pivot with respect to the tip holder; and a shaft coupled to the tip holder, wherein the shaft is configured to be received within a makeup applicator.

According to an embodiment, a method for applying makeup may include providing a wand having a brush with a stamp coupled to a distal end of the brush; inserting the wand into a reservoir of a mascara product; applying, with the stamp in a first position, the mascara product to eyelashes of a first eye with the brush; pivoting the stamp from the first position to a second position; and pressing the stamp, in the second position, on a first surface to create a beauty mark on the first surface.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

FIG. 4A shows a perspective view of the tip holder and shaft of the insert assembly of FIG. 3A, according to an embodiment of the present disclosure;

FIG. 4B shows a side view of the tip holder and shaft of FIG. 4A, according to an embodiment of the present disclosure;

FIG. 4C shows a top view of the tip holder and shaft of FIG. 4A, according to an embodiment of the present disclosure;

FIG. 4D shows another side view of the tip holder and shaft of FIG. 4A, rotated 90 degrees from the position of FIG. 4B, according to an embodiment of the present disclosure;

FIG. 4E shows another side view of the tip holder and shaft of FIG. 4A, rotated to a position between FIGS. 4B and 4D, according to an embodiment of the present disclosure;

DETAILED DESCRIPTION

Accordingly, one embodiment includes a makeup applicator that may include a mascara applicator at one end and a stamp at a distal end of the mascara applicator. The mascara applicator may apply makeup to the eyelashes with a brush. The stamp may be coupled to the brush of the mascara applicator with a pivot device. The stamp may pivot, move, swivel, click, and/or bend between one or more angled positions and a straight position. The stamp may be locked into place in the desired position. The stamp may be used as a stamp for a winged eye look. Accordingly, the stamp may bend to the left and the right to allow for the winged eye look to be created on the left and right eyes. The stamp may be selectively pivotable about a longitudinal access of the mascara applicator.

Figure 1:
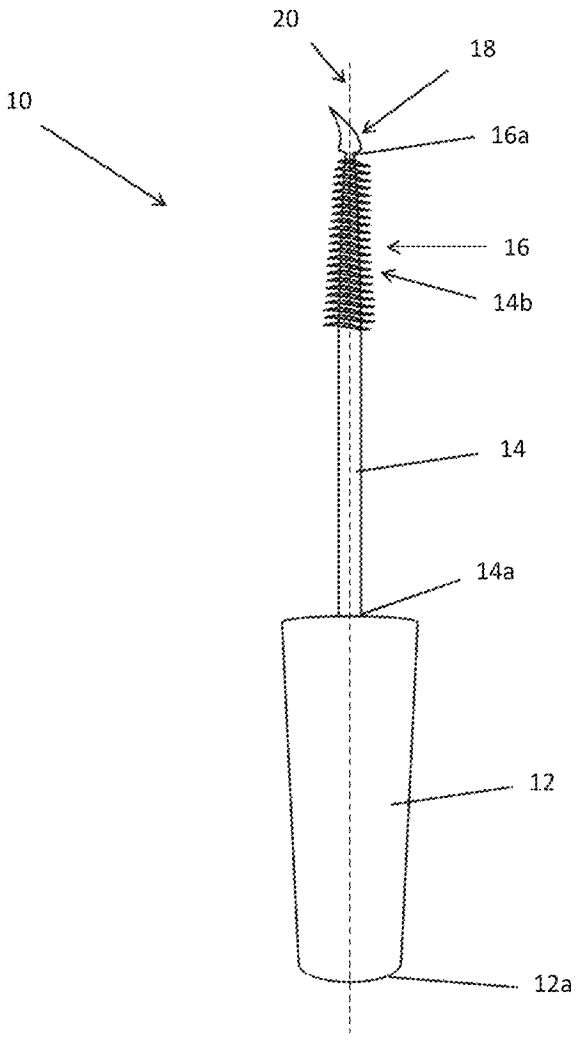
FIG. 1 shows a schematic of a makeup applicator, according to an embodiment of the present disclosure.

Referring to FIG. 1, a makeup applicator 10 is shown. The makeup applicator 10 may be a mascara applicator wand. The makeup applicator 10 may include a handle 12 and a wand 14 extending from the handle 12. The wand may be coupled to the handle 12 at a proximal end 14*a*. The handle 12 may be a substantially tubular shaped cap with a closed end 12*a*, as is typical of mascara applicators. The handle 12 may include threads or other connection mechanism on an inner surface of the tubular cap for coupling to a reservoir or receptacle of liquid makeup or mascara product (not depicted), as is known in the art. The makeup applicator 10 may include a brush 16 coupled to a distal end 14*b* of the wand 14. The brush 16 may be a separate component coupled to the wand 14 or may be formed integral with and/or around an outer surface of the wand 14. The brush 16 may be a brush for applying a mascara product onto eyelashes.

With continued reference to FIG. 1, a tip 18 may be coupled at a distal end 16*a* of the brush 16. The tip 18 may be coupled to the brush 16 or to the wand 14 which may extend through the brush 16. The tip 18 may be a stamp. The tip 18 may be shaped to create a winged or cat eye effect. Of course, other shapes for the stamp are also contemplated. For example, the tip 18 may be a triangle, a curved triangle (e.g. similar to a comma), a circular sector (e.g. similar to a "pie slice"), an s-shape, a curved shape, a wedge, etc. Although depicted and described for creating a winged eye, the tip 18 may take other forms or shapes to form beauty marks with a liquid mascara product. For example, the tip 18 may be a flower, moon, heart, star, crescent moon, etc., or combinations thereof. Additionally, the winged eye may be rounder, longer, shorter, more pointed, etc., to provide a desired winged eye effect. The tip 18 may be a soft plastic, a latex-free material, or a combination thereof, although other materials are contemplated. The tip 18 may be releasably secured to the wand 14 such that the tip 18 may be interchangeable with a stamp of a different shape. Alternatively, the tip 18 may be permanently secured to the wand 14 and/or integrally formed with the wand 14.

As previously described, the tip 18 may be coupled to the wand 14 or brush 16 at the distal end 16*a* of the brush 16. The coupling may be a pivot device (not depicted). The pivot device may pivot, move, swivel, click, and/or bend the tip 18 into various positions. The pivot device may allow the tip 18 to pivot or rotate with respect to a longitudinal axis 20 of the makeup applicator 10. The tip 18 may have a first position, shown in FIG. 1, with the tip 18 extending vertically or generally in an "up-right" position. The position of FIG. 1 may be a neutral position generally straight along the same axis as the longitudinal axis 20. The tip 18 may be pivoted or rotated to the left or right from this position. The tip 18 may pivot halfway to the left and halfway to the right. When pivoted to the left and right positions, the tip 18 may be applied to respective right and left eyes of a user to achieve the winged eye look. The tip 18 may be locked in each of the positions. Additional increments of pivoting of the tip 18 may be contemplated to achieve the desired eye effect.

The pivot device coupling the tip 18 to the distal end 16*a* that facilitates the pivoting of the tip 18 may be a ratchet, a ball and socket connection, and pawl and tooth engagement, or other rotational actuation or rotary actuation devices. Alternatively, the pivot device may be an electrical, magnetic, or pneumatic actuator. The pivot device may include a lever or button to lock and/or unlock the tip 18 from each of the pivotable positions.

Figures 2A, 2B, 2C:
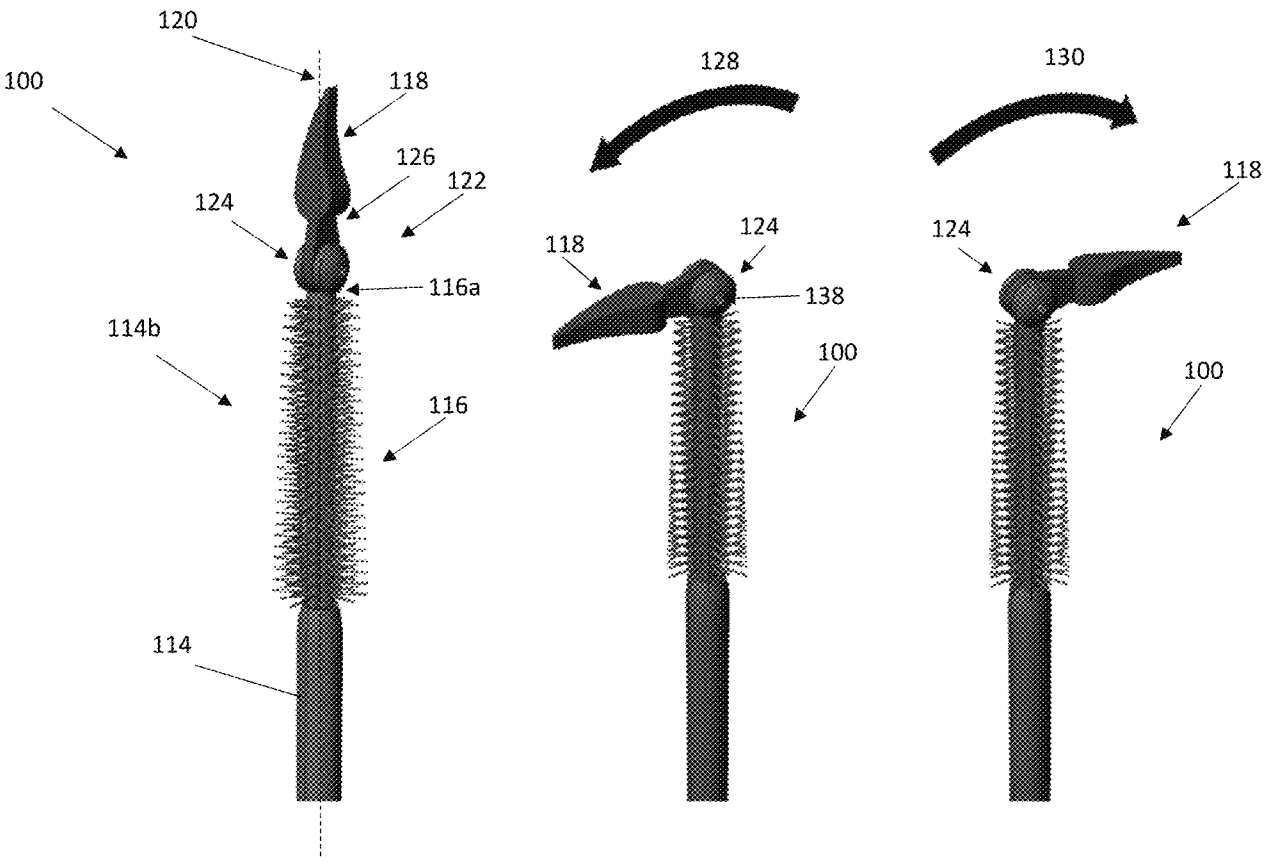
FIG. 2A shows a makeup applicator in a first position for applying makeup, according to an embodiment of the present disclosure.
FIG. 2B shows the makeup applicator of FIG. 2A in a second position for applying makeup, according to an embodiment of the present disclosure.
FIG. 2C shows the makeup applicator of FIG. 2A in a third position for applying makeup, according to an embodiment of the present disclosure.

Referring to FIGS. 2A-2C, views of an exemplary makeup applicator 100 are shown. The makeup applicator 100 may be the same or similar as the makeup applicator 10. Although not depicted, the wand 114 may be coupled at proximal end (e.g. 14*a* of FIG. 1) to a handle (e.g. 12 of FIG. 1). Referring to FIG. 2A, the wand 114 may include a brush 116 coupled to a distal end 114*b* of the wand 114. The brush 116 may be a separate component coupled to the wand 114. Alternatively, the brush 116 may be formed integral with and/or around an outer surface of the wand 114. The brush 116 may be a brush for applying a mascara product to eyelashes.

With continued reference to FIG. 2A, the wand 114 may include an insert assembly 122 at a distal end 116*a* of the brush 116. The insert assembly 122 may include a tip 118 and a tip holder 124. The tip 118 may be a stamp, similar to or the same as tip 18 (FIG. 1). The tip 118 may be shaped to create a winged or cat eye effect. For example, the tip 118 may be a triangle, a curved triangle (e.g. similar to a comma), a circular sector (e.g. similar to a "pie slice"), an s-shape, a curved shape, a wedge, etc. Although depicted and described for creating a winged eye, the tip 118 may take other forms or shapes to form beauty marks with a liquid mascara product, as discussed with respect to tip 18. The tip 118 may be a soft plastic, a latex-free material, or a combination thereof, although other materials are contemplated.

Figures 3A, 3B, 3C, 3D:
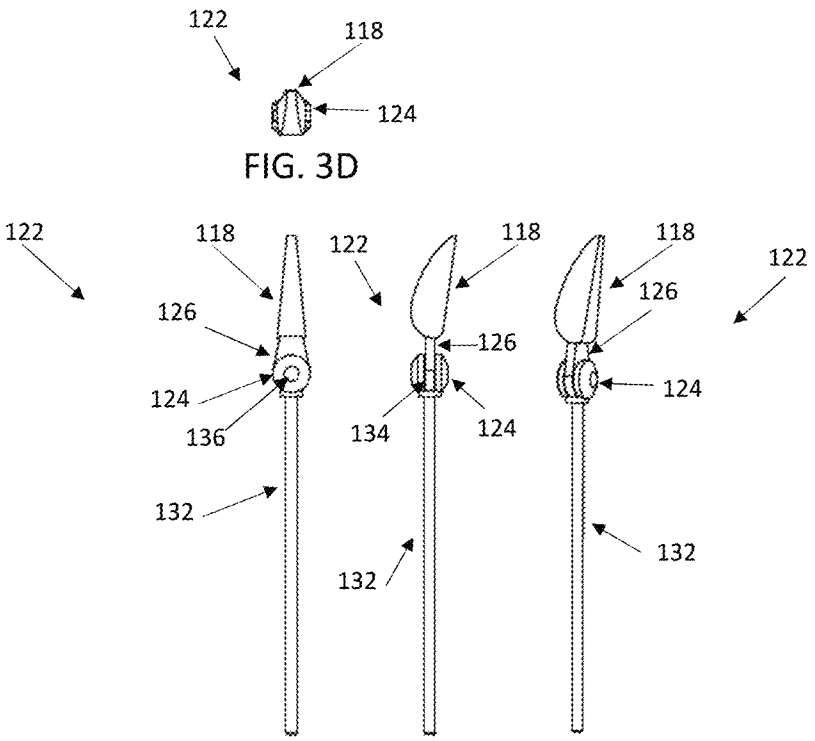
FIG. 3A shows a side view of an insert assembly for a makeup applicator, according to an embodiment of the present disclosure.
FIG. 3B shows another side view of the insert assembly of FIG. 3A, rotated 90 degrees from the position of FIG. 3A, according to an embodiment of the present disclosure.
FIG. 3C shows another side view of the insert assembly of FIG. 3A, rotated to a position between FIGS. 3A and 3B, according to an embodiment of the present disclosure.
FIG. 3D shows a top view of the insert assembly of FIG. 3A, according to an embodiment of the present disclosure.
Figures 5A, 5B, 5C, 5D:
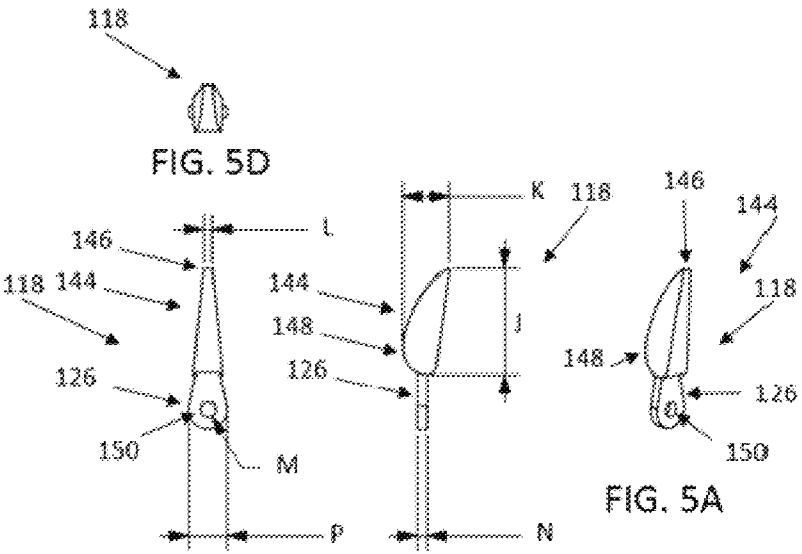
FIG. 5A shows a perspective view of a tip of the insert assembly of FIG. 3A, according to an embodiment of the present disclosure.
FIG. 5B shows a side view of the tip of FIG. 5A, according to an embodiment of the present disclosure.
FIG. 5C shows another side view of the tip of FIG. 5A, rotated 90 degrees from the position of FIG. 5B, according to an embodiment of the present disclosure.
FIG. 5D shows a top view of the tip of FIG. 5A, according to an embodiment of the disclosure.

The tip 118 may be received within the tip holder 124, as will be described in more detail in FIGS. 3-5. The tip 118 may include a flange 126 that may be received within the tip holder 124. The flange 126 may be permanently or releasably secured to the tip holder 124. That is, the flange 126 may be releasable coupled, for example, with a pin or screw, such that the tip 118 may be interchanged with other shaped tips. The tip holder 124 may include a shaft 132 (FIG. 3A). The shaft 132 may extend within a bore of the brush 116 and/or wand 114. The shaft 132 may be secured within the brush 116 and/or wand 114 with an adhesive, threaded engagement, locking mechanism, etc.

With reference to FIGS. 2B and 2C, the tip 118 may be permitted to move or pivot between one or more positions. That is, the coupling between the tip 118 and the tip holder 124 may permit the tip 118 to move relative to the tip holder 124 and thus relative to the brush 116 and wand 114. The coupling may allow the tip 118 to pivot or rotate with respect to a longitudinal axis 120 (FIG. 2A) of the makeup applicator 100. The coupling may be a pivot device, as previously described with respect to FIG. 1. The coupling may be a fastener 138 (FIG. 2B). Accordingly, the makeup applicator 100 may have a variety of application positions. For example, the makeup applicator 100 may have a first position in FIG. 2A. In the first position, the tip 118 may be vertical or generally in an "up-right position." The position of FIG. 2A may be a neutral position generally straight along the same axis of the longitudinal axis 120. The first position of FIG. 2A may correspond to a position allowing a user to apply a makeup product, such as mascara, to the eyelashes using the brush 116. The tip 118 may be pivoted or rotated to the left or right from the first position of FIG. 2A.

Referring to FIG. 2B, the makeup applicator 100 may have a second position. In the second position, the tip 118 may be moved, rotated, or pivoted in a direction 128. The tip 118 may move with respect to the tip holder 124, the brush 116, and/or the wand 114. Moving the tip 118 in the direction 128 may move the tip 118 to position substantially horizontal position that is perpendicular to the longitudinal axis 120 (FIG. 2A). Alternatively, the tip 118 may be moved to a position between the vertical position of FIG. 2A and the horizontal position of FIG. 2B. The position of FIG. 2B may correspond to a tip applicator position allowing a user to apply a makeup product, such as mascara, using the tip 118. For example, the second position of FIG. 2B may correspond to a position that allows the user to apply a winged or cat eye effect to the left eye. That is, the user, holding the handle 12 (FIG. 1), may face the tip 118 toward the eyelid with the point 146 (FIG. 5A) closest to the eye and the rounded portion 148 (FIG. 5A) farthest from the eye. The user may then press the tip 118 against the eyelid, applying the makeup product to the eyelid. The tip 118 may be locked in the position of FIG. 2B. Additional increments of pivoting of the tip 118 may be contemplated to achieve the desired eye effect.

Referring to FIG. 2C, the makeup applicator 100 may have a third position. In the third position, the tip 118 may be moved or pivoted in a direction 130. The tip 118 may move with respect to the tip holder 124, the brush 116, and/or the wand 114. Moving the tip 118 in the direction 130 may move the tip 118 to position substantially horizontal position that is perpendicular to the longitudinal axis 120 (FIG. 2A) and opposite (e.g. 180 degrees from) the position of FIG. 2B. Alternatively, the tip 118 may be moved to a position between the vertical position of FIG. 2A and the horizontal position of FIG. 2C. The position of FIG. 2C may correspond to a tip applicator position allowing a user to apply a makeup product, such as mascara, using the tip 118. For example, the third position of FIG. 2C may correspond to a position that allows the user to apply a winged or cat eye effect to the right eye. That is, the user, holding the handle 12 (FIG. 1), may face the tip 118 toward the eyelid with the point 146 (FIG. 5A) closest to the eye and the rounded portion 148 (FIG. 5A) farthest from the eye. The user may then press the tip 118 against the eyelid, applying the makeup product to the eyelid. The tip 118 may be locked in the position of FIG. 2C. Additional increments of pivoting of the tip 118 may be contemplated to achieve the desired eye effect.

During application, with the makeup applicator 100 in the position of FIG. 2A, the user may dip or insert the end of the wand 114 having the brush 116 and tip 118 into a reservoir of mascara product. The user may insert the wand 114 into the reservoir so that an entirety of the brush 116 is covered in mascara product. The user may then apply the mascara to the eyelashes in a known manner using the bristles of the brush 116. The user may again insert the end of the wand 114 into the reservoir. The user may insert only as much of the wand 114 as is necessary to coat the tip 118 with mascara product. Alternatively, the user may simply use the wand 114 after application with the brush 116 if sufficient mascara product remains on the brush 116 after application to the eyelashes. The user may pivot, move, swivel, or click the tip 118 to the position of FIG. 2B or 2C depending on the direction the user desires for the tip 118. After the tip 118 has been moved to FIG. 2B or 2C, the user may press the tip 118 onto the eyelid of a first eye applying pressure so that the mascara product is transferred from the tip 118 to the eyelid. The user may repeat the pressure application as needed to create the desired effect. The user may repeat the process of adding makeup product to the tip 118 as necessary to create the desired effect.

When the first eye is complete, the user may pivot, move, swivel, or click the tip 118 back to the position of FIG. 2A. The user may insert the wand 114 into the reservoir, as previously described, if more mascara product is desired or needed. Although, this step may be omitted if sufficient mascara product remains on the tip 118 to be applied to the second eye. The user may then pivot, move, swivel, or click the tip 118 to the other of the position of FIG. 2B or 2C (e.g. if the user previously moved the tip 118 to the position of FIG. 2B, the user now moves the tip 118 to the position of FIG. 2C, the opposite direction as originally moved for the first eye). The user may press the tip 118 onto the eyelid of the second eye, applying pressure so that the mascara product is transferred from the tip 118 to the eyelid. When the second eye is complete, the user may move the tip 118 back to the position of FIG. 2A. The wand 114 may be returned to the reservoir and the handle 12 (FIG. 1) may be secured to the reservoir for storage of the makeup applicator 100. The user may repeat the pressure application as needed to create the desired effect. The user may repeat the process of adding makeup product to the tip 118 as necessary to create the desired effect.

Although not described, the user may scrape or remove excess mascara product from the brush 116 and/or tip 118 as necessary during the application to the eyelashes and eyelids, respectively. Although described with reference to application on the eyelids, the stamp may be applied to other locations or body parts as desired by the user, including, for example, other locations on the face. The makeup applicator 10 and tip 18 may be operated in the same or similar manner.

Referring to FIGS. 1 and 2, the brush 16 may be shaped to apply a mascara product to the eyelashes. For example, the brush 16 or 116 may be conical. That is, the bristles or hairs of the brush 16 or 116 may be longer near a lower end (e.g. the end farthest from tip 18 or 118) and shorter near an upper end (e.g. the end nearest to tip 18 or 118). Thus, the bristles or hairs of the brush 16 or 116 may gradually decrease in length from the lower end to the upper end. Alternatively, or additionally, the bristles or hairs may gradually decrease in thickness and/or frequency from the lower end to the upper end of the brush 16 or 116. In this manner, when applying the stamp of the tip 18 or 118 to the eyelid, the short bristles or hairs near the upper end may prevent or reduce the application of mascara from the bristles onto the eyelid.

Additionally, or alternatively, one longitudinal side of the brush 16 or 116 may have hairs or bristles of a first length and the other longitudinal side may hairs or bristles of a second length. The first length may be shorter than the second length. Each side may be half of the brush 16 or 116. Thus, the first side with the first length may be for applying mascara product to lower eyelashes and the second side with the second length may be for applying mascara product to upper eyelashes. The bristles or hairs on both sides may gradually decrease in length from the lower end to the upper end as previously described, such that the brush 16 or 116 is conical.

Alternatively, or additionally, the bristles or hairs may be thinner near the tip 18 or 118. Alternatively, or additionally, the brush 16 or 116 may be corn cob shaped such that the bristles are short near a lower end of the brush 16 or 116, gradually increase in length to or near to a midpoint and then gradually decrease in length to the upper end near the tip 18 or 118. Alternatively, or additionally, the corn cob may include thinner or fewer bristles or hairs near the ends as compared to the midpoint which may include thicker or more bristles or hairs. The bristles or hairs may be shaped or dimensioned to promote volume on the eyelashes while preventing or inhibit transfer from the bristles or hairs to the eyelids during application with the tip 18 or 118.

FIGS. 3A-3D show views of the insert assembly 122. The insert assembly 122 may include a tip 118, tip holder 124, shaft 132, and fastener 138 (FIG. 2B). The tip holder 124 and shaft 132 may be formed integrally and/or unitarily. As previously mentioned, the shaft 132 may be received within a bore of a wand 14, 114 and/or brush 16, 116. The shaft 132 may be secured within the brush 116 and/or wand 114 with an adhesive, threaded engagement, locking mechanism, etc. The flange 126 of the tip 118 may be received within a slot 134 of the tip holder 124. The flange 126 of the tip 118 may be secured within the slot 134 of the tip holder 124 with a fastener 138 (FIG. 2B). The fastener 138 may extend through apertures 136 (only one visible in FIG. 3A) on the tip holder 124 and a corresponding aperture 150 (FIG. 5A) on the tip 118. The fastener 138 may be a pin, bolt, screw, rod, or other shaft. The fastener 138 may be secured in the respective apertures by a nut or other securing member. The fastener 138 may allow for relative movement between the tip 118 and the tip holder 124. That is, as described previously, the fastener 138 may allow the tip 118 to rotate or swivel between the positions previously described.

FIGS. 4A-4E show views of the tip holder 124 and shaft 132 of the insert assembly 122 (FIGS. 3A-3C) with the tip 118 and fastener 138 omitted. The tip holder 124 and shaft 132 may have a combined length A. The length A may be about 40.5 mm (about 1.594 inches). The shaft 132 may have a length B. The length B may extend from the end of the shaft 132*a* to a lower surface of an enlarged portion 140. The length B may be about 36.08 mm (about 1.420 inches).

The shaft 132 may have a diameter C. The diameter C may be about 1.2 mm (about 0.047 inches). The shaft 132 may be coupled to the tip holder 124 at the enlarged portion 140. The enlarged portion 140 may have a diameter D. The diameter D may be about 2.4 mm (about 0.083 inches). The enlarged portion 140 may be integral with the shaft 132. The tip holder 124 may then be coupled or secured to the enlarged portion 140 of the shaft 132. Alternatively, the enlarged portion 140 may be integral with the tip holder 124. The shaft 132 may then be coupled or secured to the enlarged portion 140. Alternatively, the shaft 132, the enlarged portion 140, and the tip holder 124 may be formed integrally, such as, for example, with molding.

With continued reference to FIGS. 4A-4E, the tip holder 124 may comprise a first side 124*a* and a second side 124*b*. The first side 124*a* and the second side 124*b* may be joined by the enlarged portion 140. A slot 142 may be defined between the first side 124*a* and the second side 124*b*. Each of the first side 124*a* and the second side 124*b* may have a diameter E. The diameter E may be about 4 mm (about 0.157 inches). The outer surfaces of the first side 124*a* and the second side 124*b* may be separated by a distance F. The distance F may be about 3.87 mm (about 0.152 inches). The slot 142, extending between the inner surfaces of the first side 124*a* and second side 124*b*, may have a width G. The width G may be about 1.2 mm (about 0.047 inches). Each of the first side 124*a* and the second side 124*b* may an aperture 136 (only one aperture 136 visible in FIG. 4B). The aperture 136 may have a diameter H. The diameter H may be about 1.6 mm (about 0.063 inches). The diameter H may vary by about 0.05 mm (0.002 inches) larger or smaller. As previously described, the aperture 136 may receive a fastener 138 (FIG. 2B).

FIGS. 5A-5D show views of a tip 118 of the insert assembly 122 (FIGS. 3A-3C) with the tip holder 124, shaft 132, and fastener 138 omitted. The tip 118 may include a stamp portion 144 and a flange 126. The stamp portion 144 may correspond to the desired beauty mark or shape (e.g. a triangle, a curved triangle (e.g. similar to a comma), a circular sector (e.g. similar to a "pie slice"), an s-shape, a curved shape, a wedge, a flower, moon, heart, star, crescent moon, etc., or combinations thereof). The stamp portion 144 may have a length J and a depth K. The length J may be about 10.95 mm (about 0.431 inches) and the depth K may be about 4.82 mm (about 0.190 inches). The stamp portion 144 may be wedge shaped or shaped as a section of an egg shape. The stamp portion 144 may extend from a point 146 to curved or rounded portion 148. The point 146 may have a width L. The width L may be about 0.93 mm (about 0.037 inches).

With continued reference to FIGS. 5A-5D, the stamp portion 144 may be formed integrally with the flange 126 such that the tip 118 is a unitary piece. The flange 126 may have an aperture 150. The aperture 150 may have a diameter M. The diameter M may be about 1.6 mm (about 0.063 inches). The flange 126 may have a thickness N and a width P. The thickness N may be about 1.00 mm (about 0.039 inches) and the width P may be about 4.00 mm (0.157 inches). Thus, as previously described, the flange 126 may be received in the slot 142 of the tip holder 124. When placed in the slot 142, the aperture may align with the apertures 136 (FIG. 4A) of the first side 124*a* and second side 124*b* of the tip holder 124. The fastener 138 (FIG. 2B) may extend through the aperture 136 in the first side 124*a*, the aperture 150 of the flange 126, and the aperture 136 of the second side 124*b*. Thus, the flange 126, fastener 138, and tip holder 124 may operate as a pivot device. The fastener 138 may be secured (e.g. with a nut) within the respective apertures. The fastener 138 may be releasable secured within the respective apertures. When the tip 118 takes on different forms, such as other shapes or beauty marks, the tip 118 may include a stamp portion 144 (corresponding to the shape, e.g. a star) and a flange 126, such that the tips 118 may be interchangeable in the makeup applicator 100 without also changing the tip holder 124 and shaft 132.

According to an embodiment a makeup applicator may include a wand having a proximal end and a distal end, the proximal end coupled to a handle; a brush coupled to the distal end; and a stamp coupled to the distal end of the wand at an end of the brush, wherein the brush is configured to apply a mascara product to eyelashes and the stamp is configured to apply the mascara product to eyelids. The stamp may be formed of a latex-free plastic. The stamp may be configured to apply a winged eye shape to eyelids. The stamp may be coupled to the distal end of the wand with a pivot device, wherein the pivot device is configured to move the stamp between a neutral position, a left pivoted position, and a right pivoted position. The makeup applicator may include a locking device, wherein the locking device is configured to selectively retain the stamp in the neutral position, the left pivoted position, and the right pivoted position. The pivot device may be one of a ratchet, a ball and socket, a pawl and tool, or a rotary actuator. The stamp may be one of a triangle, a curved triangle, a circular sector, an s-shape, a curved shape, a wedge, a flower, a moon, a heart, a star, or a crescent moon or a combination thereof.

According to an embodiment, a method for applying makeup may include providing a wand having a brush and a stamp coupled to a distal end; inserting the wand into a reservoir of a mascara product; applying the mascara product to eyelashes of a first eye with the brush; inserting the wand into the reservoir; pivoting the stamp from a neutral position to a left pivoted position and locking the stamp in the left pivoted position; and pressing the stamp on an eyelid of the first eye to create a winged eye effect. The method may include applying mascara product to eyelashes of a second eye with the brush prior to pivoting the stamp to the left pivoted position; pivoting the stamp from the left pivoted position, through the neutral position, and to the right pivoted position; and pressing the stamp on an eyelid of the second eye to create the winged eye effect.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A makeup applicator, the makeup applicator comprising:

a wand having a proximal end, a distal end, and a bore;

a handle coupled to the proximal end of the wand;

a brush coupled around an outer surface of the distal end of the wand;

a shaft having a shaft longitudinal axis from a proximal end to a distal end, the shaft fixedly secured within the bore with an adhesive, threaded engagement, or locking mechanism, the shaft extending through the brush and the wand; and a stamp configured to apply a beauty mark to a surface, the stamp having a proximal end pivotally coupled to the distal end of the shaft and a distal end, the stamp comprising:

a first substantially planar surface;

a second substantially planar surface; and a stamp surface extending between the first substantially planar surface and the second substantially planar surface, the stamp surface being at least partially non-planar, wherein the stamp has a stamp longitudinal axis that is parallel to the shaft longitudinal axis, wherein the first substantially planar surface and the second substantially planar surface taper along the stamp longitudinal axis from the proximal end of the stamp to the distal end of the stamp, and wherein the stamp is configured to pivot with respect to the brush.

2. The makeup applicator of claim 1, wherein the stamp is formed of a latex-free plastic.

3. The makeup applicator of claim 1, wherein the brush is configured to apply a makeup product to eyelashes and the stamp is configured to apply the makeup product to eyelids.

4. The makeup applicator of claim 1, wherein the stamp surface is configured to apply a winged eye shape to eyelids.

5. The makeup applicator of claim 1, wherein the stamp is coupled to the distal end of the brush with a pivot device, wherein the pivot device is configured to move the stamp between a neutral position, a left pivoted position, and a right pivoted position.

6. The makeup applicator of claim 5, wherein the pivot device comprises a flange, a fastener, and a tip holder.

7. The makeup applicator of claim 1, wherein the stamp further comprises a flange, the flange configured to be received in a tip holder coupled to the shaft, wherein the stamp is configured to pivot with respect to the tip holder.

8. The makeup applicator of claim 7, wherein the flange comprises a first aperture and the tip holder comprises at least one second aperture, wherein the first aperture and the at least one second aperture are aligned.

9. The makeup applicator of claim 8, further comprising a fastener received within the first aperture and the at least one second aperture.

10. The makeup applicator of claim 1, wherein the stamp is a triangle, a curved triangle, a circular sector, a wedge, or a section of an egg shape.

11. A makeup applicator comprising:

a wand having a bore; and an insert having:

a tip holder having a slot;

a tip having a stamp portion, the tip configured to be received in the slot and configured to pivot with respect to the tip holder; and a shaft having a shaft longitudinal axis from a proximal end to a distal end, the shaft coupled to the tip holder at the distal end of the shaft, wherein the shaft is fixedly secured within the bore of the wand with an adhesive, threaded engagement, or locking mechanism, and wherein the stamp portion has:

a first substantially planar surface;

a second substantially planar surface; and a stamp surface extending between the first substantially planar surface and the second substantially planar surface, the stamp surface being at least partially non-planar, wherein the stamp portion has a stamp longitudinal axis that is parallel to the shaft longitudinal axis, and wherein the first substantially planar surface and the second substantially planar surface taper along the stamp longitudinal axis from a proximal end of the stamp portion to a distal end of the stamp portion.

12. The makeup applicator of claim 11, the tip further comprising a flange comprising a flange aperture.

13. The makeup applicator of claim 11, wherein the stamp portion is a triangle, a curved triangle, a circular sector, or a section of an egg shape.

14. The makeup applicator of claim 12, the tip holder further comprising at least one tip holder aperture, wherein the tip holder aperture and the flange aperture align to receive a fastener.

15. The makeup applicator of claim 14, wherein the fastener is configured to allow the tip to pivot with respect to the tip holder.

16. The makeup applicator of claim 1, further comprising a lock configured to lock the stamp in a position.

* * * * *